US012376655B2

(12) United States Patent
Pomering

(10) Patent No.: US 12,376,655 B2
(45) Date of Patent: Aug. 5, 2025

(54) CONNECTOR

(71) Applicant: MIPS AB, Täby (SE)

(72) Inventor: Amy Louise Pomering, Täby (SE)

(73) Assignee: MIPS AB, Täby (SE)

( * ) Notice: Subject to any disclaimer, the term of this patent is extended or adjusted under 35 U.S.C. 154(b) by 0 days.

(21) Appl. No.: 17/784,183

(22) PCT Filed: Dec. 11, 2020

(86) PCT No.: PCT/EP2020/085816
§ 371 (c)(1),
(2) Date: Jun. 10, 2022

(87) PCT Pub. No.: WO2021/122388
PCT Pub. Date: Jun. 24, 2021

(65) Prior Publication Data

US 2023/0023020 A1 Jan. 26, 2023

(30) Foreign Application Priority Data

Dec. 18, 2019 (GB) ..... 1918754

(51) Int. Cl.
*A44B 17/00* (2006.01)

(52) U.S. Cl.
CPC ..... *A44B 17/0076* (2013.01)

(58) Field of Classification Search
CPC .... A44B 17/0076; A41D 13/015; A42B 3/064
See application file for complete search history.

(56) References Cited

U.S. PATENT DOCUMENTS

2002/0163114 A1 11/2002 Lobry et al.
2006/0064900 A1 3/2006 Aveni
2010/0115686 A1 5/2010 Halldin
2011/0296594 A1 12/2011 Thomas et al.
(Continued)

FOREIGN PATENT DOCUMENTS

CA 3091441 A1 1/2023
CN 107847003 A 3/2018
(Continued)

OTHER PUBLICATIONS

Office Action for corresponding Canadian Patent Application No. 3,164,983, dated Sep. 11, 2023 ( 6 pages).
(Continued)

*Primary Examiner* — David M Upchurch
(74) *Attorney, Agent, or Firm* — Husch Blackwell LLP

(57) ABSTRACT

A connector for connecting inner and outer layers of an apparatus. The connector includes an anchor point connectable to the inner or outer layers. A resilient portion surrounds the anchor point about a first axis and connected to the anchor point. A peripheral portion surrounds the resilient portion about a second axis and connected to the resilient portion and connected to the other of the inner and outer layers. An attachment means on a surface of the connector opposite to the anchor point attaches the connector to the inner or outer layer not connected to the anchor point. The resilient portion protrudes from the peripheral portion deforms to allow the anchor point to move relative to the peripheral portion in a direction perpendicular to the first direction.

17 Claims, 17 Drawing Sheets

(56) References Cited

U.S. PATENT DOCUMENTS

| | | | | |
|---|---|---|---|---|
| 2013/0042397 | A1 | 2/2013 | Halldin | |
| 2013/0291289 | A1 | 11/2013 | Szalkowski et al. | |
| 2016/0316846 | A1 | 11/2016 | Salvetti et al. | |
| 2017/0172242 | A1* | 6/2017 | Leatt | A42B 3/127 |
| 2018/0000186 | A1 | 1/2018 | Brown | |
| 2019/0328073 | A1 | 10/2019 | Morgan | |
| 2019/0343212 | A1 | 11/2019 | Keevy et al. | |
| 2020/0046056 | A1* | 2/2020 | Hawkes | A42B 3/064 |

FOREIGN PATENT DOCUMENTS

| | | |
|---|---|---|
| EP | 3391765 | 10/2018 |
| WO | WO 2001/045526 | 6/2001 |
| WO | WO 2011/139224 | 11/2011 |
| WO | WO 2018/129447 | 7/2018 |
| WO | WO 2019/214960 | 11/2019 |
| WO | WO 2020/128052 | 6/2020 |

OTHER PUBLICATIONS

Chinese Office Action for Application No. 202080088959.9, dated Mar. 13, 2025, 7 pages.

* cited by examiner

CONNECTOR

RELATED APPLICATIONS

This application is a 35 USC § 371 National Stage application of International Application No. PCT/EP2020/085816, entitled "CONNECTOR," filed on Dec. 11, 2020, which claims the benefit of United Kingdom Patent Application No. 1918754.1, filed on Dec. 18, 2019, the disclosure of which is incorporated herein by reference in its entirety.

The present invention relates to connectors between inner and outer parts of an apparatus. In particular the present invention relates to an apparatus, such as a helmet, that may include a sliding interface between two components.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets may be used in ice hockey, cycling, motorcycling, motor-car racing, skiing, snow-boarding, skating, skateboarding, equestrian activities, American football, baseball, rugby, soccer, cricket, lacrosse, climbing, golf, airsoft, roller derby and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device for fixing the helmet to the user's head, and it is the attachment device that can vary in dimension to fit the user's head whilst the main body or shell of the helmet remains the same size. In some cases, comfort padding within the helmet can act as the attachment device. The attachment device can also be provided in the form of a plurality of physically separate parts, for example a plurality of comfort pads which are not interconnected with each other. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer called a liner. In other arrangements, such as a rugby scrum cap, a helmet may have no hard outer shell, and the helmet as a whole may be flexible. In any case, nowadays, a protective helmet has to be designed so as to satisfy certain legal requirements which relate to inter alia the maximum acceleration that may occur in the centre of gravity of the brain at a specified load. Typically, tests are performed, in which what is known as a dummy skull equipped with a helmet is subjected to a radial blow towards the head. This has resulted in modern helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotation energy and/or redirecting it into translational energy rather than rotational energy.

Such oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include Mild Traumatic Brain Injuries (MTBI) such as concussion, and Severe Traumatic Brain Injuries (STBI) such as subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational force, such as the duration, amplitude and rate of increase, either concussion, SDH, DAI or a combination of these injuries can be suffered. Generally speaking, SDH occur in the case of accelerations of short duration and great amplitude, while DAI occur in the case of longer and more widespread acceleration loads.

In helmets such as those disclosed in WO 2001/045526 and WO 2011/139224 that may reduce the rotational energy transmitted to the brain caused by oblique impacts, two parts of the helmet may be configured to slide relative to each other following an oblique impact. Connectors may be provided that, whilst connecting the parts of a helmet together, permit movement of the parts relative to each other under an impact.

In order to provide such a helmet, it may be desirable to provide two components that can slide relative to each other, providing a sliding interface. It may also be desirable to be able to provide such a sliding interface without substantially increasing the manufacturing costs and/or effort.

According to an aspect of the disclosure there is provided a connector for connecting inner and outer layers of an apparatus, the connector comprising: an anchor point configured to be connected to one of the inner and outer layers; a resilient portion arranged to at least partially surround the anchor point about a first axis extending in a first direction and connected to the anchor point; a peripheral portion arranged to at least partially surround the resilient portion about a second axis extending in the first direction and connected to the resilient portion, and configured to be connected to the other of the inner and outer layers; and attachment means on a surface of the connector opposite to the anchor point, for attaching the connector to the inner or outer layer not to be connected to the anchor point; wherein the resilient portion is configured to protrude from the peripheral portion in the first direction, in a connected state in which the connector is connected to the inner and outer layers, and deform to allow the anchor point to move relative to the peripheral portion in a direction perpendicular to the first direction.

Optionally, the attachment means is provided on a surface of the peripheral portion. This may improve the stability of a connection arrangement including the connector.

Optionally, the attachment means is a hook and loop attachment means. This may simplify installation of the connector Optionally, in a non-deformed state, the resilient portion is substantially flat, and the connected state is a deformed state of the resilient portion. This feature may provide a more compact connector and actively pull components of the apparatus together for a more compact apparatus. Alternatively, in a non-deformed state, the resilient portion protrudes from the peripheral portion in the first direction. This feature may provide a connector that is relatively easily installed.

Optionally, the resilient portion extends across a central region of the connector surrounded by the peripheral region.

Optionally, the resilient portion substantially covers the entirety of the central region. This may prevent the ingress of unwanted material, such as dirt, which may interfere with the performance of the connector. Alternatively, the resilient portion comprises multiple sections having gaps therebetween. Optionally, the multiple sections extend in a radial direction relative to the first axis. This may reduce the amount of material required for the connector and/or allow the resiliency of the connector to be more finely controlled.

Optionally, the peripheral portion forms a closed loop. Optionally, the peripheral portion is substantially annular and the second axis passes through the centre of the peripheral portion. These features improve the stability of the connector.

Optionally, the anchor point is aligned with the first axis.

Optionally, the first and second axes are coincident.

Optionally, the resilient portion and the peripheral portion have rotational symmetry about the coincident first and second axes. Such an arrangement may ensure the connector performs uniformly regardless of the direction of sliding movement.

Optionally, the peripheral portion is formed from a rigid material.

Optionally, the connector further comprises an insert formed from a rigid material, the insert being configured to be inserted into the peripheral portion to prevent the peripheral portion from deforming. This may improve the stability of the connector.

Optionally, the peripheral portion is formed from a resilient material.

Optionally, the resilient portion and the peripheral portion are integrally formed. This may provide a more robust connector and/or may reduce the number of parts required.

Optionally, the anchor point comprises a snap-fit connector configured to snap fit with the inner or outer layer. This may provide a relatively simple mechanism for connection, reducing installation time, and/or a relatively robust connection mechanism.

Optionally, the connector further comprises a cap configured to cover a central region of the connector surrounded by the peripheral region so as to prevent the ingress of unwanted material to the central region.

Optionally, the connector further comprises protrusions connected to the peripheral portion and configured to anchor the peripheral portion in the inner or outer layer. This may provide a stronger connection between the connector and the apparatus.

According to a second aspect of the invention there is provided an apparatus comprising: an inner layer; an outer layer; a sliding interface between the inner layer and the outer layer; and the connector according to the first aspect connected to the inner and outer layers so as to allow relative sliding between the inner and outer layers at the sliding interface, in response to an impact to the apparatus.

Optionally, the peripheral portion is arranged between the inner and outer layers. This may improve the ease of installation of the connector, e.g. allowing retrofitting to an apparatus without significantly redesigning the apparatus.

Optionally, the inner or outer layer comprises a further attachment means complementary to the attachment means of the connector.

Optionally, the apparatus is a helmet.

Optionally, the outer layer is a hard shell and the inner layer is an energy absorbing layer. Alternatively, the inner layer is a hard shell and the outer layer comprises one or more plates connected to the hard shell. Alternatively, both the inner layer and the outer layer are energy absorbing layers. Alternatively, the outer layer is an energy absorbing layer and the inner layer is an interface layer, configured to interface with a wearer's head. Optionally, the interface layer comprises comfort padding.

The invention is described in detail below, with reference to the accompanying figures, in which.

Figure 4:
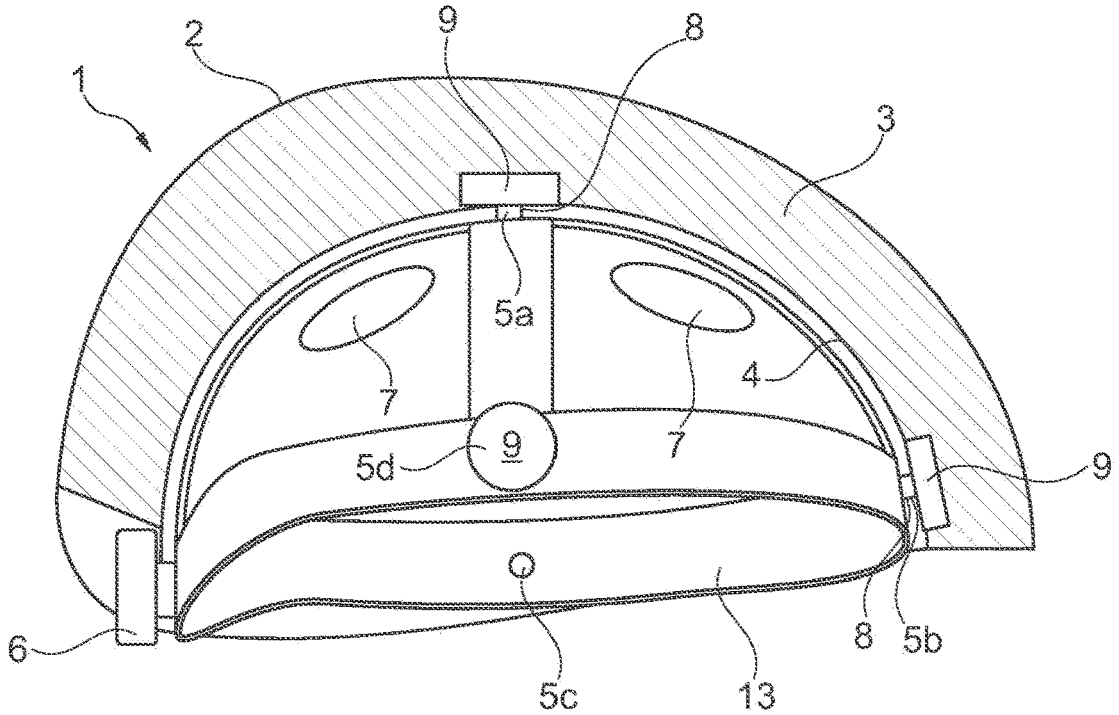
Figure 5:
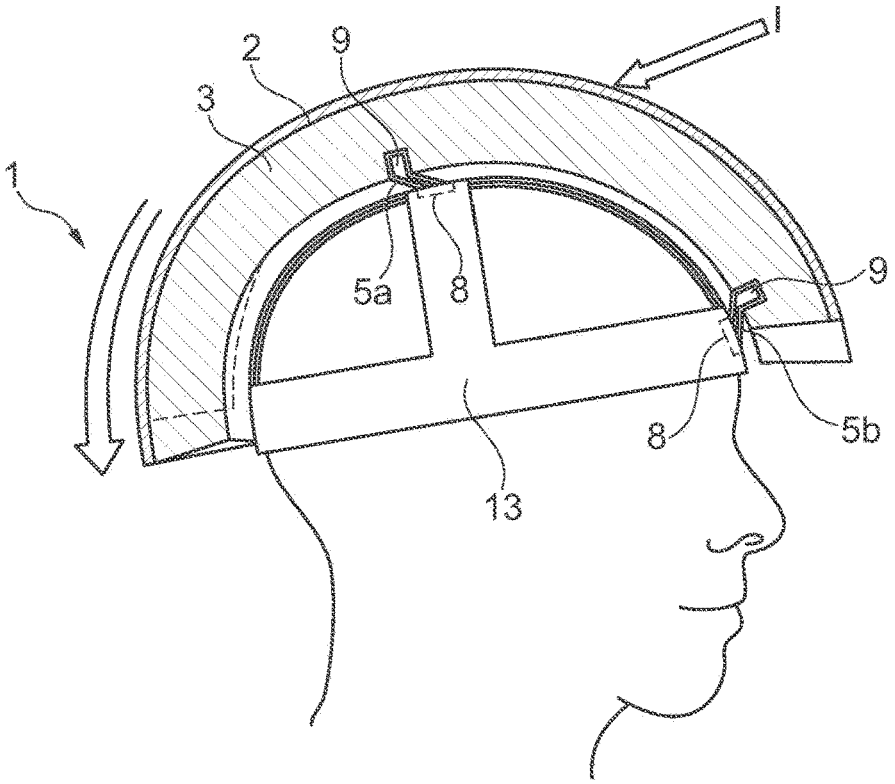
Figure 10:
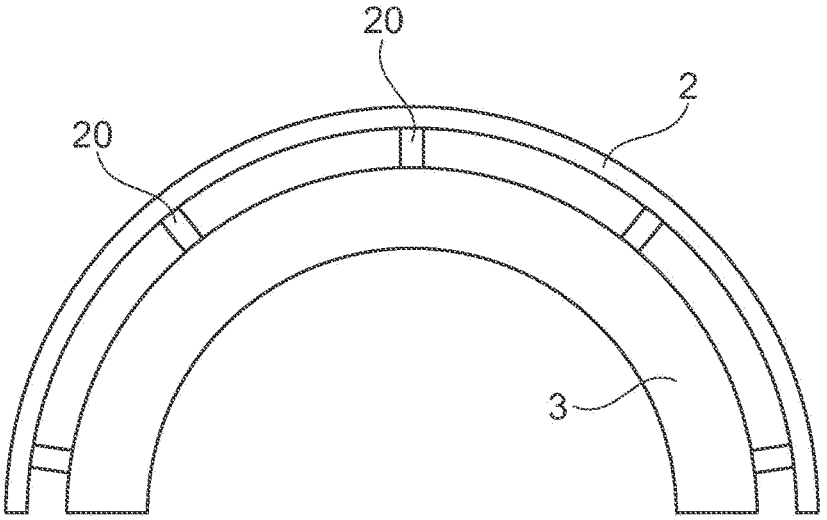
Figure 11:
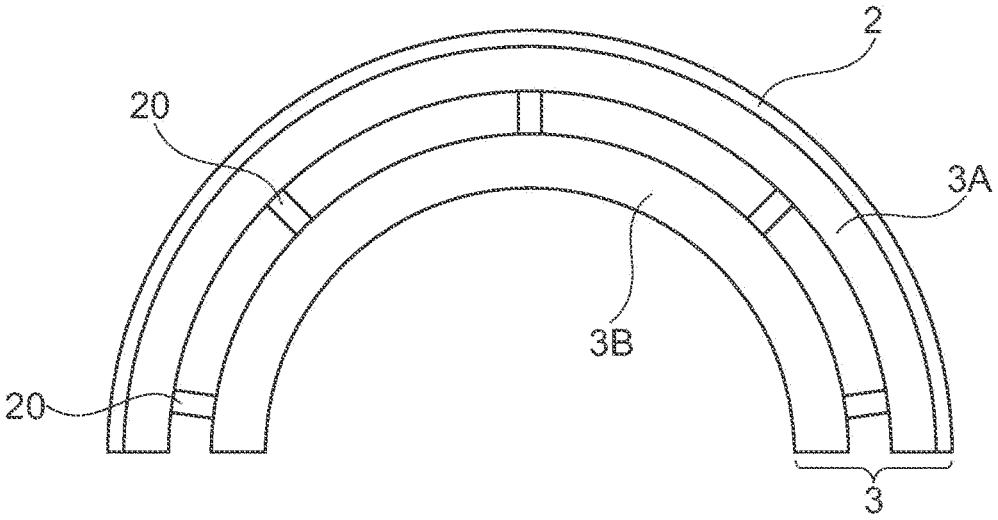
Figure 12:
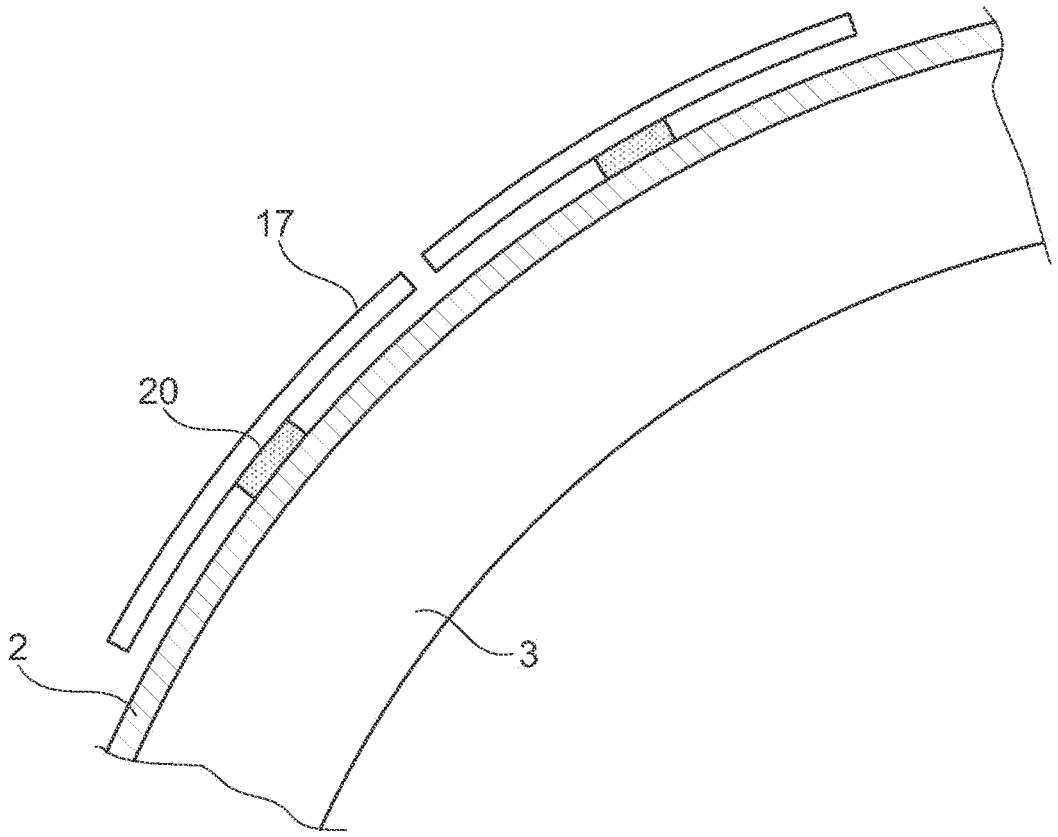
Figure 13:
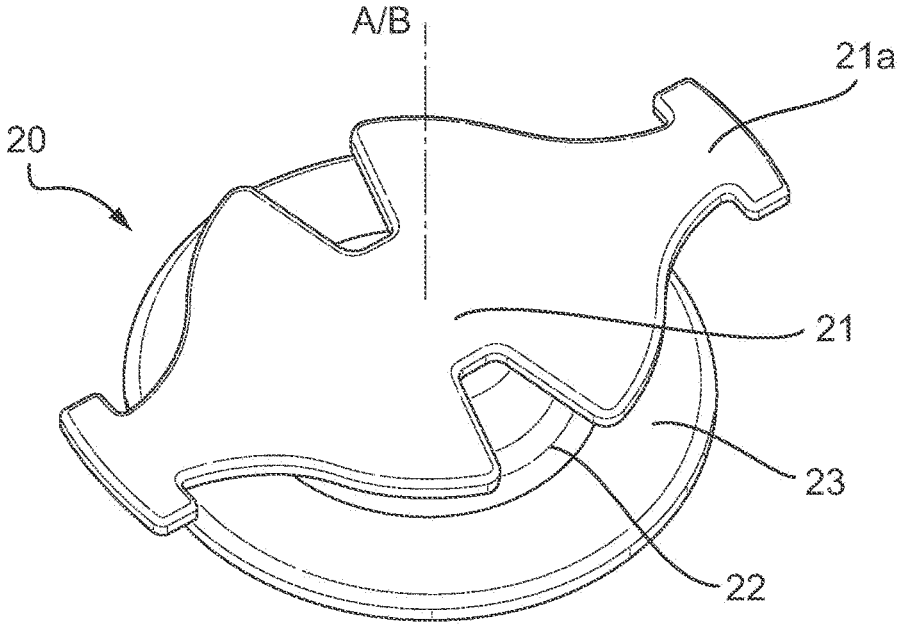
Figure 14:
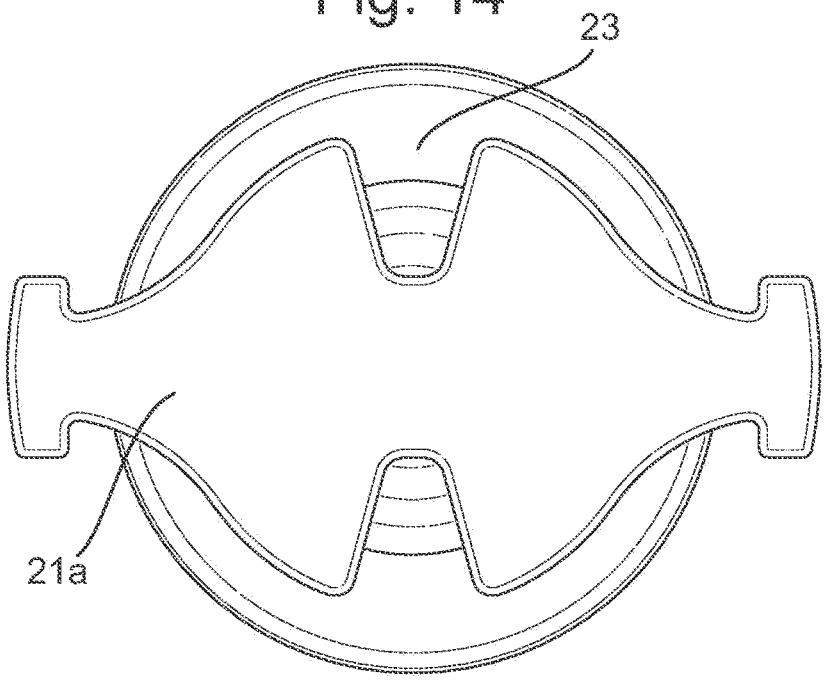
Figure 15:
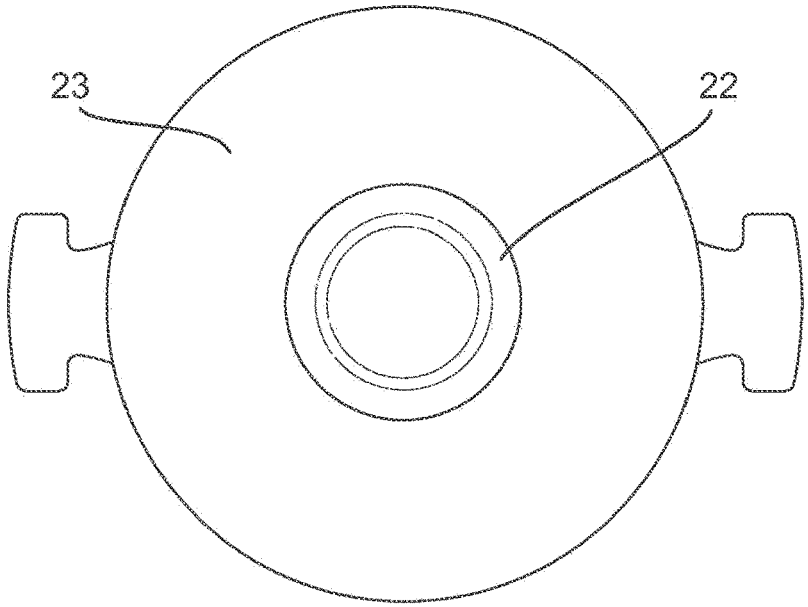
Figure 16:
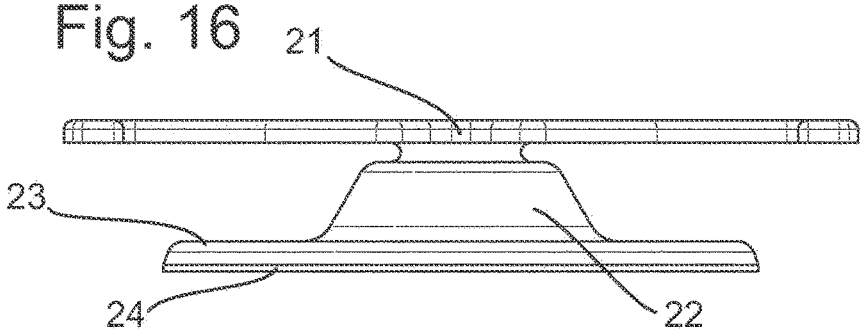
Figure 17:
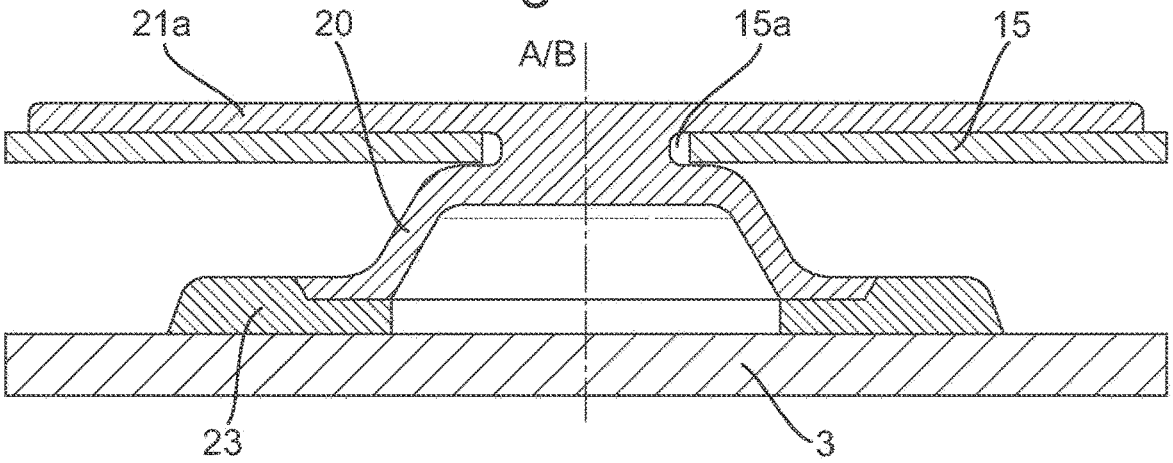
Figure 18:
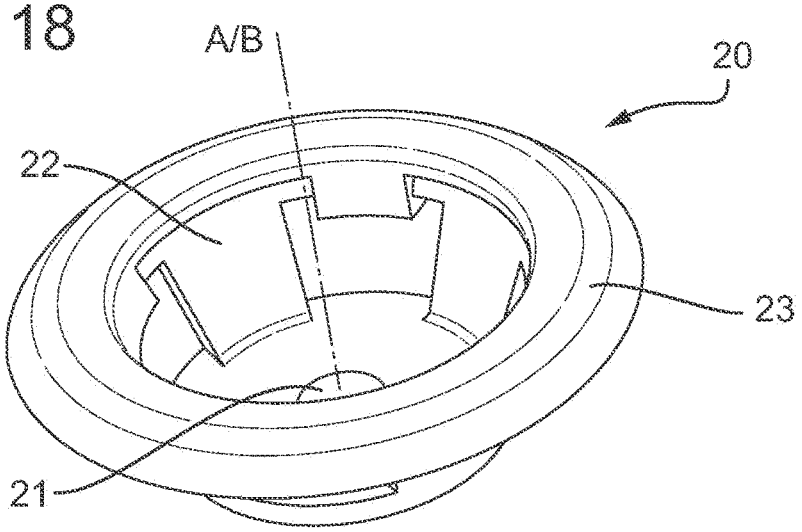
Figure 19:
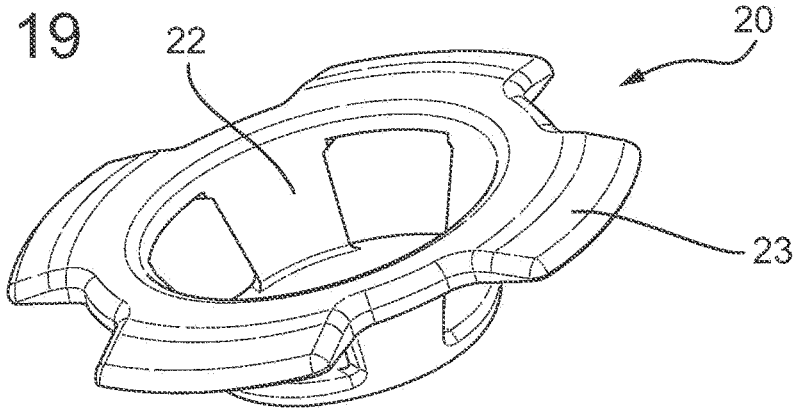
Figure 20:
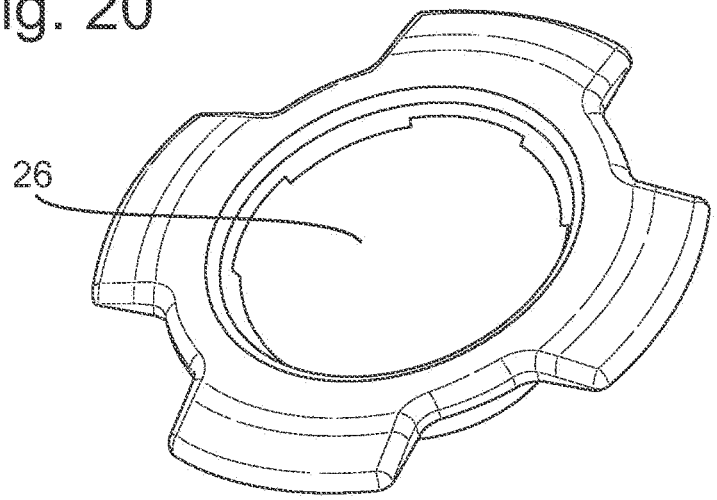
Figure 21:
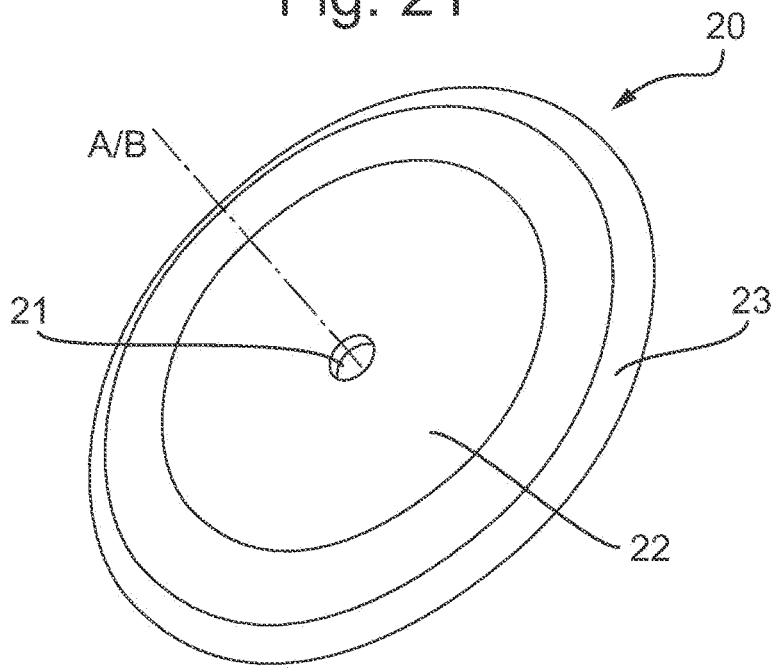
Figure 22:
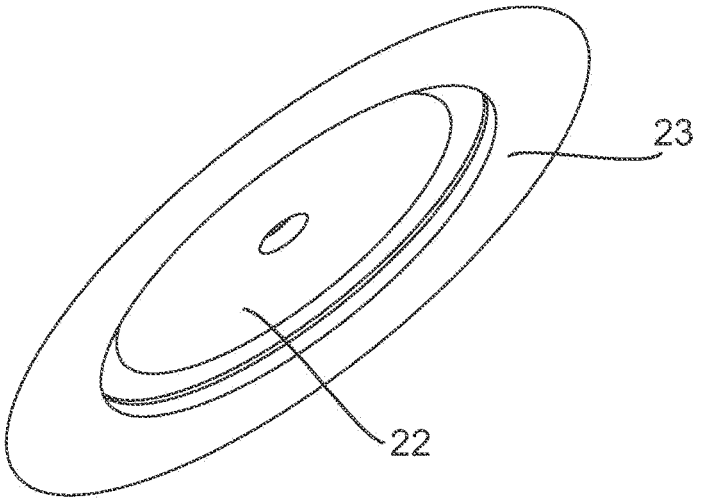
Figure 23:
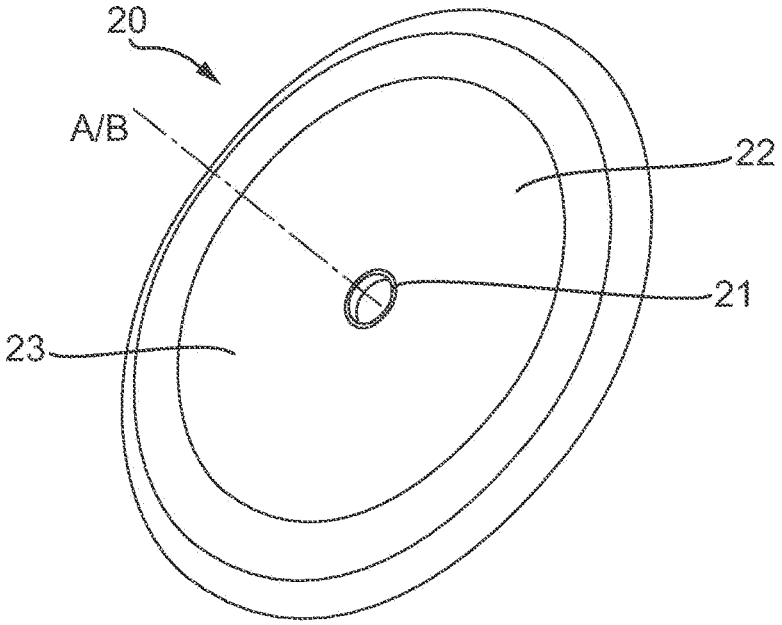
Figure 24:
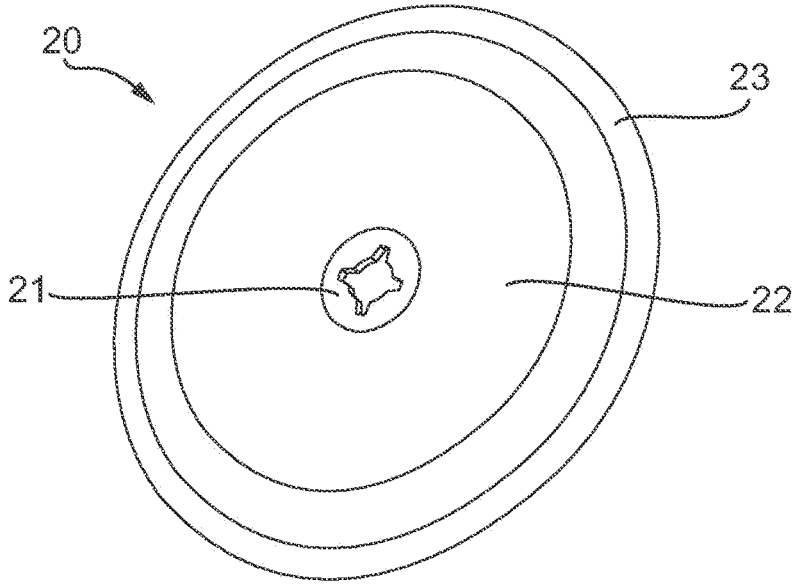
Figure 25:
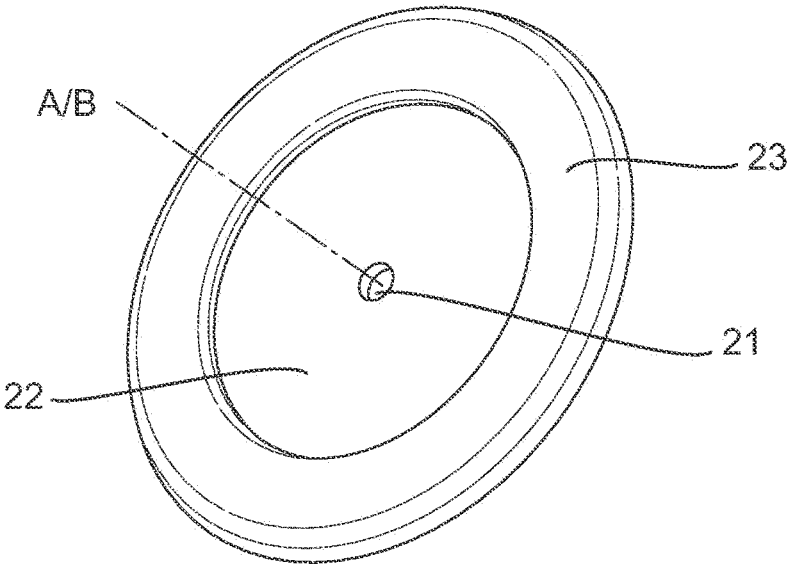
Figure 26:
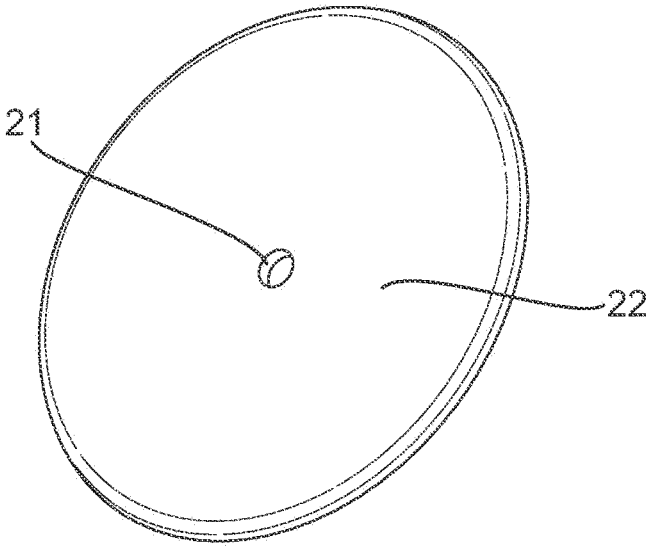
Figure 27:
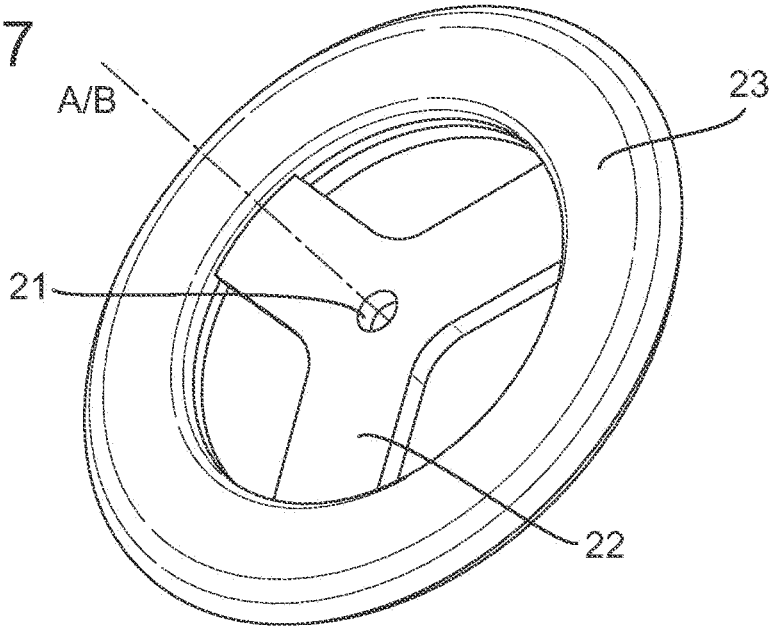
Figure 28:
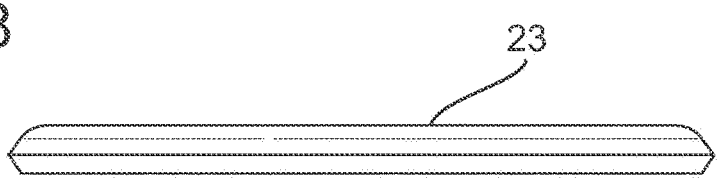
Figure 29:
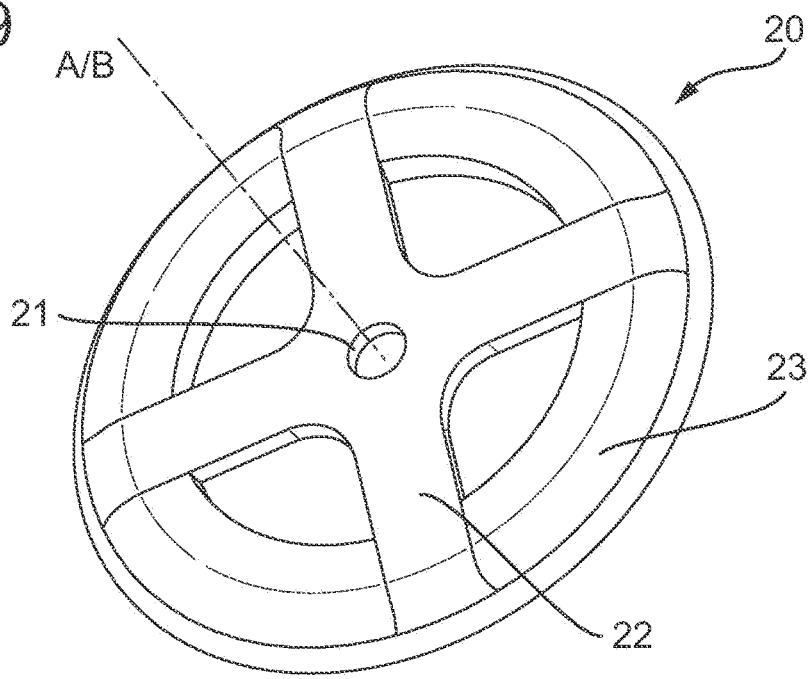
Figure 30:
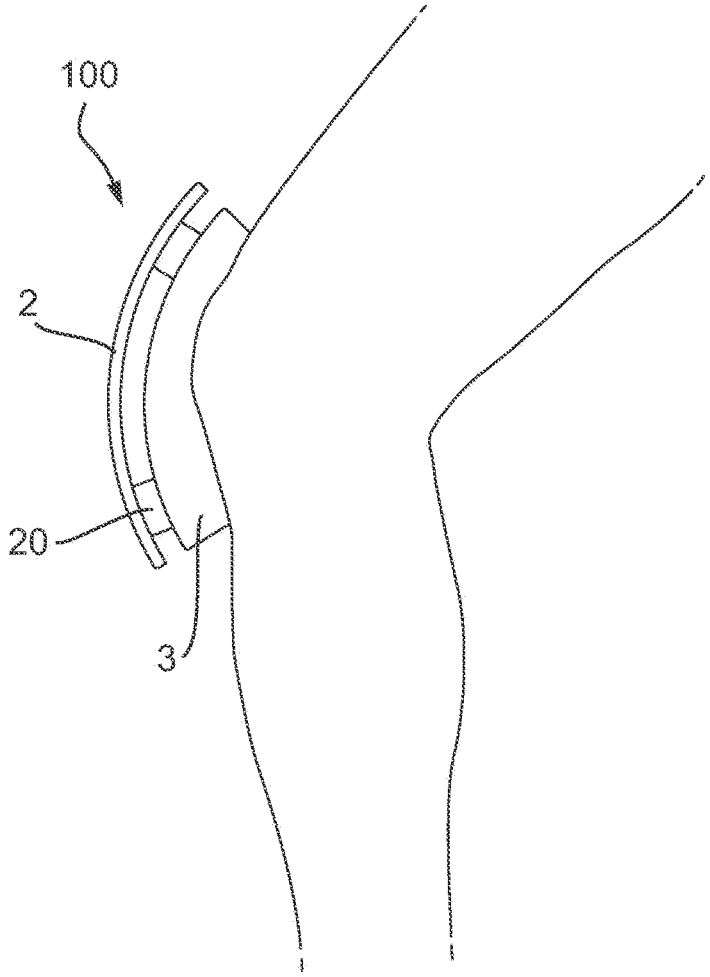
Figure 31:
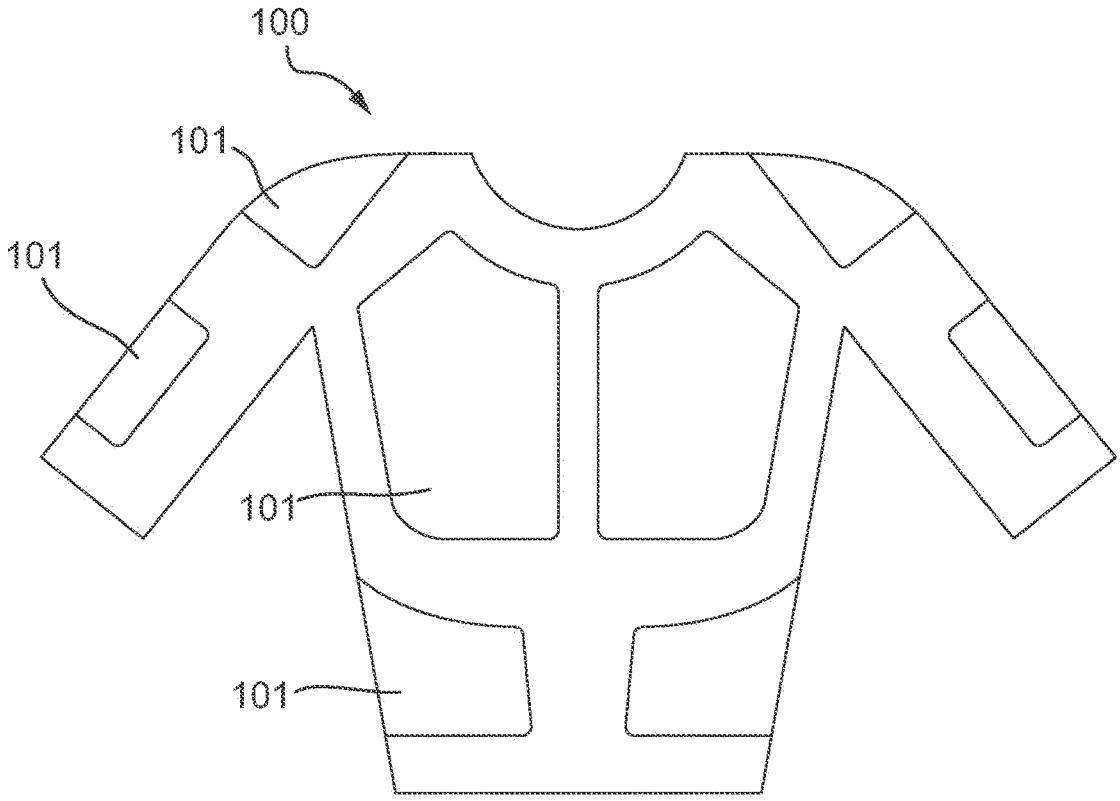
Figure 32:
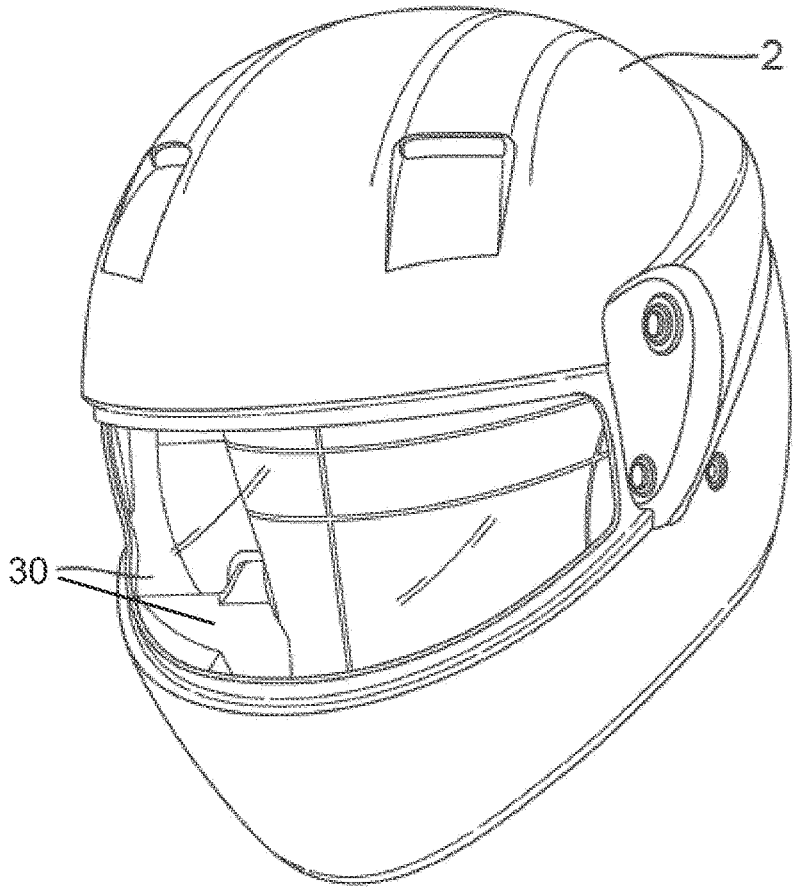
Figure 33:
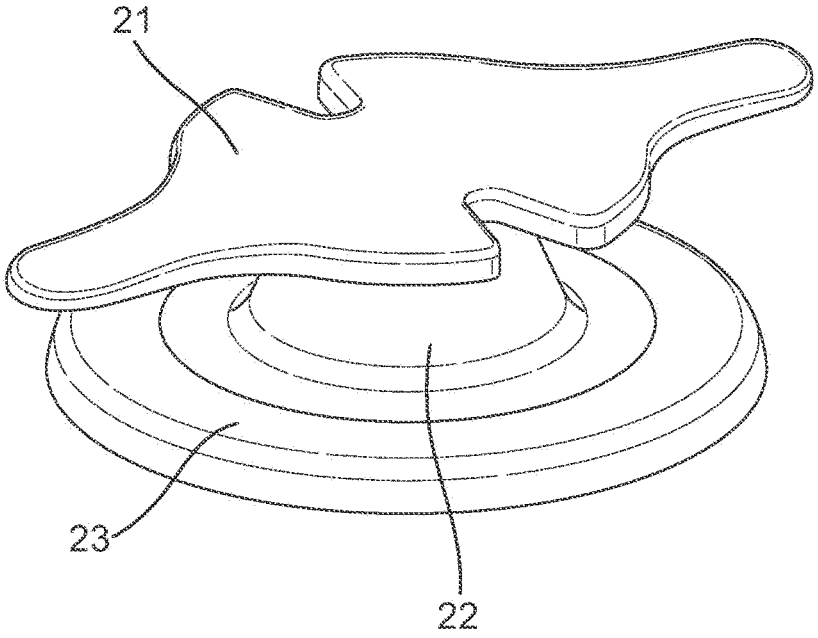

FIGS. 4 and 5 schematically depict another arrangement of a helmet;

FIGS. 6 to 9 schematically depict further arrangements of helmets;

FIG. 10 schematically depicts another arrangement of a helmet;

FIG. 11 schematically depicts another arrangement of a helmet;

FIG. 12 schematically depicts another arrangement of a helmet;

FIG. 13 shows a first view of a first example connector;

FIG. 14 shows a second view of a first example connector;

FIG. 15 shows a third view of a first example connector;

FIG. 16 shows a fourth view of a first example connector;

FIG. 17 shows a connection arrangement including the first example connector;

FIG. 18 shows a first view of a second example connector;

FIG. 19 shows a first view of a third example connector;

FIG. 20 shows a second view of a third example connector;

FIG. 21 shows a first view of a fourth example connector;

FIG. 22 shows a second view of a fourth example connector;

FIG. 23 shows a fifth example connector;

FIG. 24 shows a sixth example connector;

FIG. 25 shows a first view of a seventh example connector;

FIG. 26 shows a second view of a seventh example connector;

FIG. 27 shows a first view of an eighth example connector;

FIG. 28 shows a second view of an eighth example connector;

FIG. 29 shows a ninth example connector;

FIG. 30 shows a first example of body armour;

FIG. 31 shows a second example of body armour;

FIG. 32 shows a further example of a helmet;

FIG. 33 shows a variation of the connector of FIGS. 13 to 16.

The proportions of the thicknesses of the various layers in the helmets depicted in the figures have been exaggerated in the drawings for the sake of clarity and can of course be adapted according to need and requirements.

Figure 1:
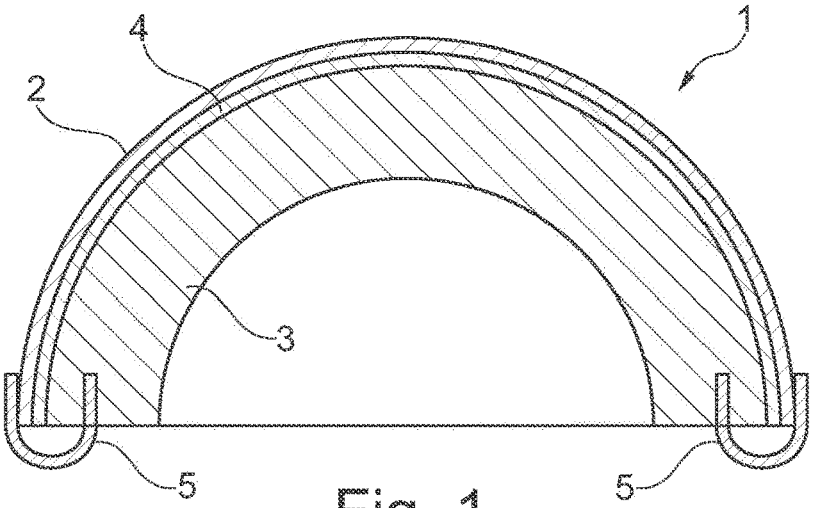
FIG. 1 depicts a cross-section through a helmet for providing protection against oblique impacts.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3 that is intended for contact with the head of the wearer.

Arranged between the outer shell 2 and the inner shell 3 is a sliding layer 4 (also called a sliding facilitator or low friction layer), which may enable displacement between the outer shell 2 and the inner shell 3. In particular, as discussed below, a sliding layer 4 or sliding facilitator may be configured such that sliding may occur between two parts during an impact. For example, it may be configured to enable sliding under forces associated with an impact on the helmet 1 that is expected to be survivable for the wearer of the helmet 1. In some arrangements, it may be desirable to configure the sliding layer 4 such that the coefficient of friction is between 0.001 and 0.3 and/or below 0.15.

Arranged in the edge portion of the helmet 1, in the FIG. 1 depiction, may be one or more connecting members 5 which interconnect the outer shell 2 and the inner shell 3. In some arrangements, the connectors may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may not be present at all.

Further, the location of these connecting members 5 can be varied (for example, being positioned away from the edge portion, and connecting the outer shell 2 and the inner shell 3 through the sliding layer 4).

The outer shell 2 is preferably relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, Twaron, carbon-fibre or Kevlar.

The inner shell 3 is considerably thicker and acts as an energy absorbing layer. As such, it is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names Poron™ and D3O™. The construction can be varied in different ways, which emerge below, with, for example, a number of layers of different materials.

Inner shell 3 is designed for absorbing the energy of an impact. Other elements of the helmet 1 will absorb that energy to a limited extent (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

A number of different materials and embodiments can be used as the sliding layer 4 or sliding facilitator, for example oil, Teflon, microspheres, air, rubber, polycarbonate (PC), a fabric material such as felt, etc. Such a layer may have a thickness of roughly 0.1-5 mm, but other thicknesses can also be used, depending on the material selected and the performance desired. The number of sliding layers and their positioning can also be varied, and an example of this is discussed below (with reference to FIG. 3*b*).

As connecting members 5, use can be made of, for example, deformable strips of plastic or metal which are anchored in the outer shell and the inner shell in a suitable manner.

Figure 2:
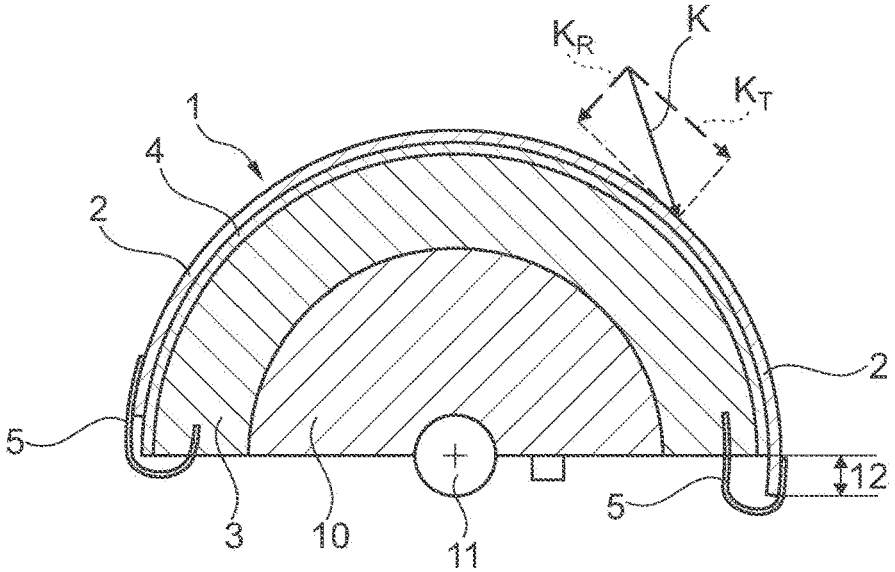
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull 10 when the helmet 1 is subjected to an oblique impact K. The impact force K gives rise to both a tangential force $K_T$ and a radial force KR against the protective helmet 1. In this particular context, only the helmet-rotating tangential force $K_T$ and its effect are of interest.

As can be seen, the force K gives rise to a displacement 12 of the outer shell 2 relative to the inner shell 3, the connecting members 5 being deformed. Significant reductions in the torsional force transmitted to the skull 10 can be obtained with such an arrangement. A typical reduction may be roughly 25% but reductions as high as 90% may be possible in some instances. This is a result of the sliding motion between the inner shell 3 and the outer shell 2 reducing the amount of energy which is transferred into radial acceleration.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3).

Figure 3A:
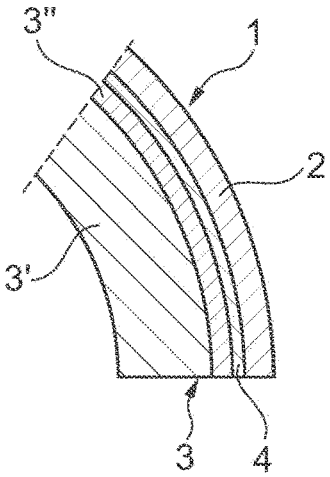
FIGS. 3A, 3B & 3C show variations of the structure of the helmet of FIG. 1.
Figure 3B:
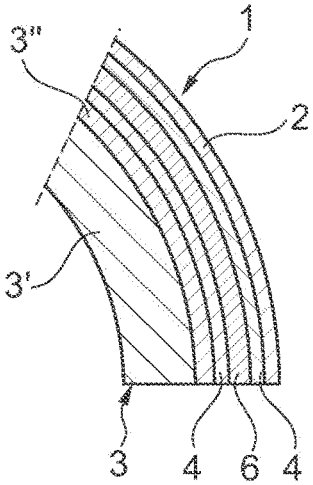
Figure 3C:
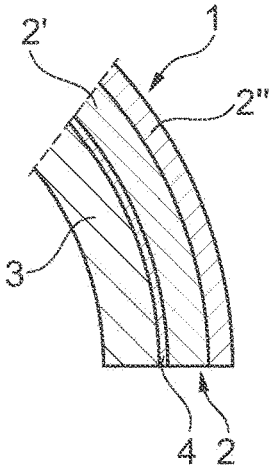

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" is preferably harder than the inner layer 3', to help facilitate the sliding with respect to outer shell 2. In FIG. 3*b*, the inner shell 3 is constructed in the same manner as in FIG. 3*a*. In this case, however, there are two sliding layers 4, between which there is an intermediate shell 6. The two sliding layers 4 can, if so desired, be embodied differently and made of different materials. One possibility, for example, is to have lower friction in the outer sliding layer than in the inner. In FIG. 3*c*, the outer shell 2 is embodied differently from previously. In this case, a harder outer layer 2" covers a softer inner layer 2'. The inner layer 2' may, for example, be the same material as the inner shell 3.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An interface layer 13 (also called an attachment device) is provided, to interface with (and/or attach helmet 1 to) a wearer's head. As previously discussed, this may be desirable when energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap of textile or a net could form the attachment device 13.

Although the attachment device 13 is shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 6 for adjusting the diameter of the head band of the attachment device 13 for the particular wearer. In other arrangements, the head band could be an elastic head band in which case the adjustment device 6 could be excluded.

A sliding facilitator 4 is provided radially inwards of the energy absorbing layer 3. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13, in the same manner as discussed above. The sliding facilitator 4 may be a material having a low coefficient of friction, or may be coated with such a material.

As such, in the FIG. 4 helmet, the sliding facilitator 8 may be provided on or integrated with the innermost side of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself can be adapted to act as a sliding facilitator 4 and may comprise a low friction material.

In other words, the sliding facilitator 4 is provided radially inwards of the energy absorbing layer 3. The sliding facilitator can also be provided radially outwards of the attachment device 13.

When the attachment device 13 is formed as a cap or net (as discussed above), sliding facilitators 4 may be provided as patches of low friction material.

The low friction material may be a waxy polymer, such as PTFE, ABS, PVC, PC, Nylon, PFA, EEP, PE and UHMWPE, or a powder material which could be infused with a lubricant. The low friction material could be a fabric material. As discussed, this low friction material could be applied to either one, or both of the sliding facilitator and the energy absorbing layer.

The attachment device 13 can be fixed to the energy absorbing layer 3 and/or the outer shell 2 by means of fixing members 5, such as the four fixing members 5*a*, 5*b*, 5*c* and 5*d* in FIG. 4. These may be adapted to absorb energy by deforming in an elastic, semi-elastic or plastic way. However, this is not essential. Further, even where this feature is present, the amount of energy absorbed is usually minimal in comparison to the energy absorbed by the energy absorbing layer 3 during an impact.

According to the arrangement shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

FIG. 5 shows an arrangement of a helmet similar to the helmet in FIG. 4, when placed on a wearer's head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some case a combination of plastic and elastic deformation in the fixing members 5 may occur, i.e. some fixing members 5 rupture, absorbing energy plastically, whilst other fixing members deform and absorb forces elastically.

In general, in the helmets of FIG. 4 and FIG. 5, during an impact the energy absorbing layer 3 acts as an impact absorber by compressing, in the same way as the inner shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain. The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries including MTBI and STBI such as subdural haematomas, SDH, blood vessel rapturing, concussions and DAI is thereby reduced.

Connectors that may be used within a helmet are described below. It should be appreciated that these connectors may be used in a variety of contexts and are not to be limited to use within helmets. For example, they may be used in other devices that provide impact protection, such as body armour or padding for sports equipment. In the context of helmets, the connectors may, in particular, be used in place of the previously known connecting members and/or fixing members of the arrangements discussed above.

Figure 6:
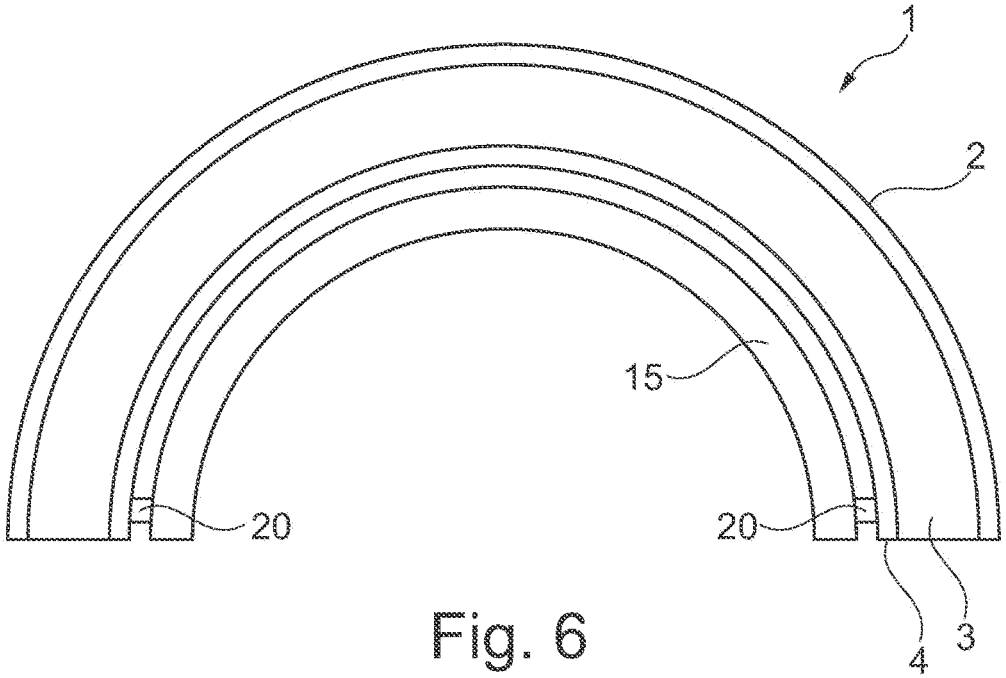

In an arrangement, the connector may be used with a helmet 1 of the type shown in FIG. 6. The helmet shown in FIG. 6 has a similar configuration to that discussed above in respect of FIGS. 4 and 5. In particular, the helmet has a relatively hard outer shell 2 and an energy absorbing layer 3. A head attachment device is provided in the form of a helmet liner 15. The liner 15 may include comfort padding as discussed above. In general, the liner 15 and/or any comfort padding may not absorb a significant proportion of the energy of an impact in comparison with the energy absorbed by the energy absorbing layer 3.

The liner 15 may be removable. This may enable the liner to be cleaned and/or may enable the provision of liners that are modified to fit a specific wearer.

Between the liner 15 and the energy absorbing layer 3, there is provided an inner shell 14 formed from a relatively hard material, namely a material that is harder than the energy absorbing layer 3. The inner shell 14 may be moulded to the energy absorbing layer 3 and may be made from any of the materials discussed above in connection with the formation of the outer shell 2. In alternative arrangements, the inner shell 14 may be formed from a fabric material, optionally coated with a low friction material.

In the arrangement of FIG. 6, a low friction interface is provided between the inner shell 14 and the liner 15. This may be implemented by the appropriate selection of at least one of the material used to form the outer surface of the liner 15 or the material used to form the inner shell 14. Alternatively or additionally, a low friction coating may be applied to at least one of the opposing surfaces of the inner shell 14 and the liner 15. Alternatively or additionally, a lubricant may be applied to at least one of the opposing surfaces of the inner shell 14 and the liner 15.

As shown, the liner 15 may be connected to the remainder of the helmet 1 by way of one or more connectors 20, discussed in further detail below. Selection of the location of the connectors 20 and the number of connectors 20 to use may depend upon the configuration of the remainder of the helmet.

In an arrangement such as shown in FIG. 6, at least one connector 20 may be connected to the inner shell 14. Alternatively or additionally, one or more of the connectors 20 may be connected to another part of the remainder of the helmet 1, such as the energy absorbing layer 3 and/or the outer shell 2. The connectors 20 may also be connected to two or more parts of the remainder of the helmet 1.

Figure 7:
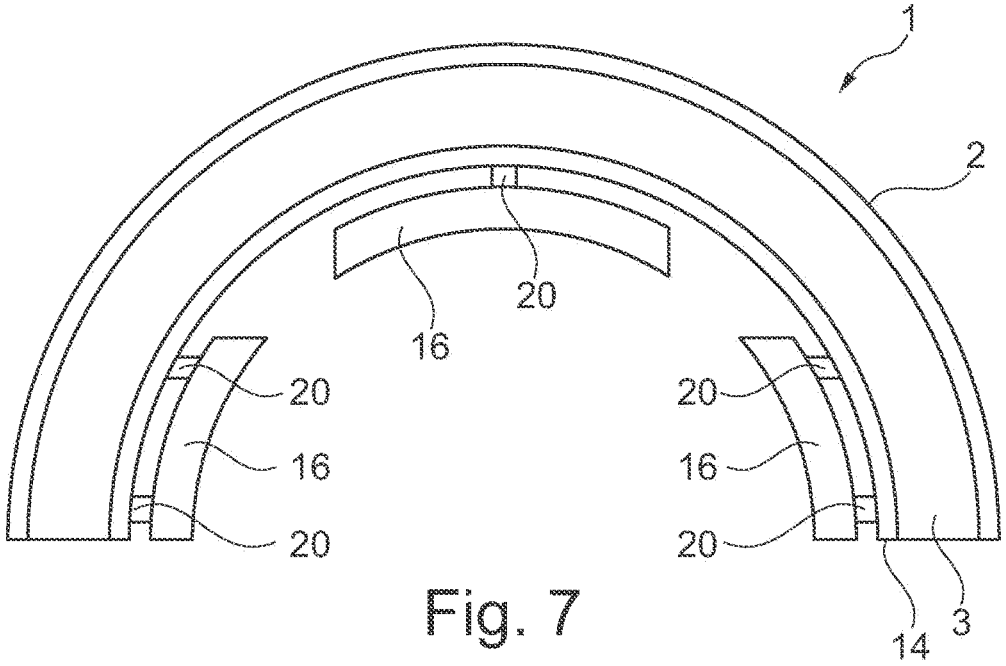

FIG. 7 depicts a further alternative arrangement of a helmet 1. As shown, the helmet 1 of this arrangement includes a plurality of independent sections of comfort padding 16. Each section of comfort padding 16 may be connected to the remainder of the helmet by one or more connectors 20.

The sections of comfort padding 16 may have a sliding interface provided between the sections of comfort padding 16 and the remainder of the helmet 1. In such an arrangement, the sections of comfort padding 16 may provide a similar function to that of the liner 15 of the arrangement shown in FIG. 6. The options discussed above for provision of a sliding interface between a liner and a helmet also apply to the sliding interface between the sections of comfort padding and the helmet.

It should also be appreciated that the arrangement of FIG. 7, namely the provision of a plurality of independently mounted sections of comfort padding 16 provided with a sliding interface between the sections of comfort padding 16 and the remainder of the helmet, may be combined with any form of helmet, including those such as depicted in FIGS. 1 to 5 that also have a sliding interface provided between two other parts of the helmet.

Figure 8:
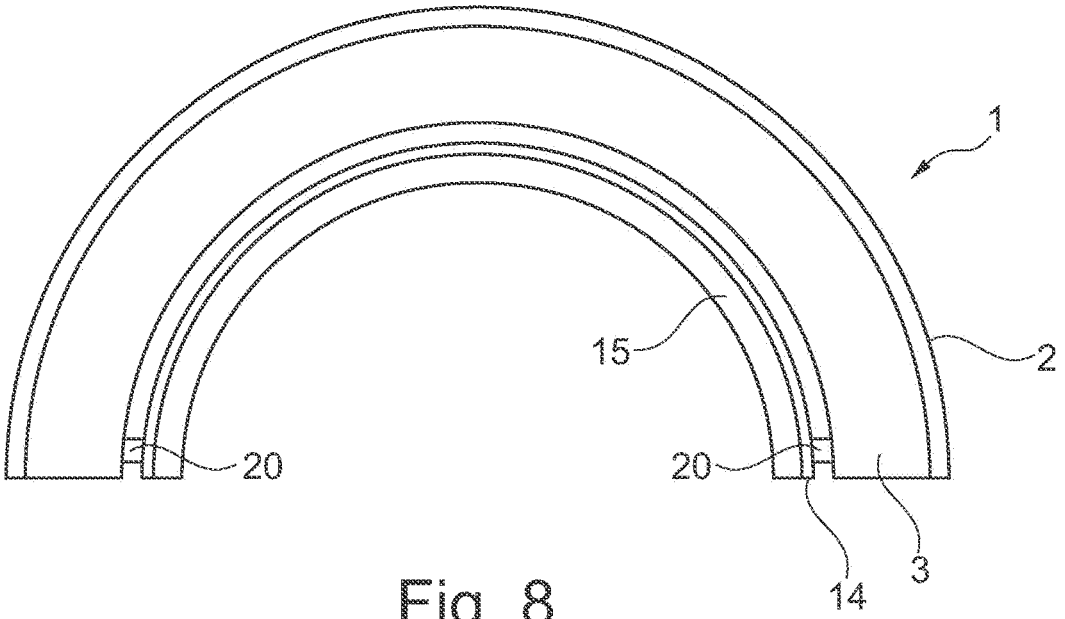
Figure 9:
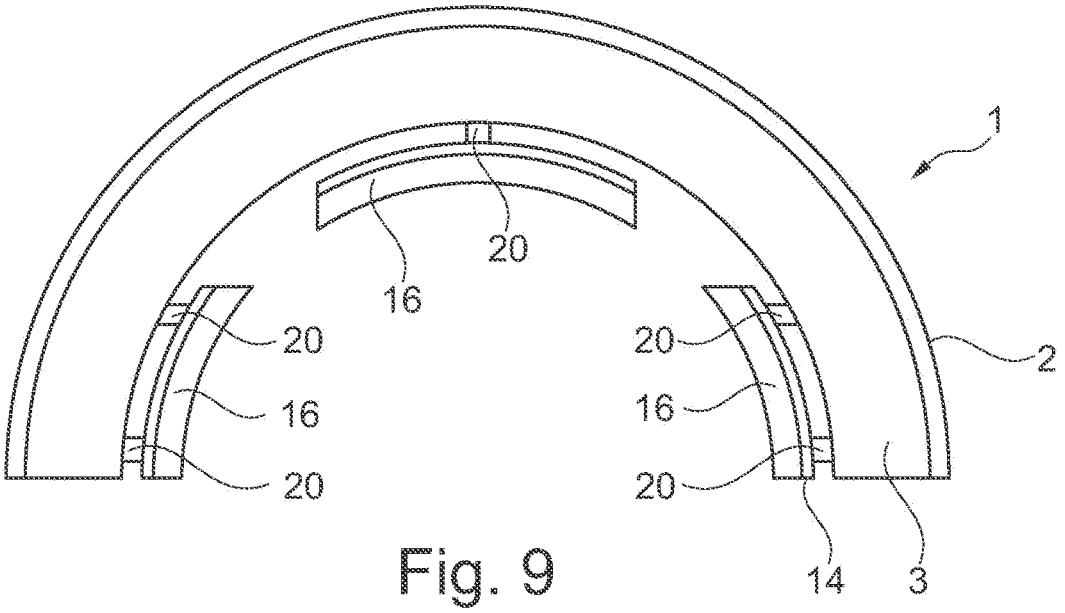

FIGS. 8 and 9 show equivalent arrangements to those of FIGS. 6 and 7, except that the inner shell 14 is applied to the liner 15 (in FIG. 8) or comfort padding 16 (in FIG. 9). In the case of FIG. 9, the inner shell 14 may only be a partial shell or a plurality of sections of shell, as compared to the substantially full shell arrangements of FIGS. 6 to 8. Indeed, in both FIGS. 8 and 9 the inner shell 14 may also be characterised as a relatively hard coating on the liner 15 or comfort padding 16. As for FIGS. 6 and 7, the inner shell 14 is formed from a relatively hard material, namely a material that is harder than the energy absorbing layer 3. For example, the material could be PTFE, ABS, PVC, PC, Nylon, PFA, EEP, PE and UHMWPE. The material may be bonded to the outer side of the liner 15 or comfort padding 16 to simplify the manufacturing process. Such bonding could be through any means, such as by adhesive or by high frequency welding or stitching. In alternative arrangements, the inner shell 14 may be formed from a fabric material, optionally coated with a low friction material.

In FIGS. 8 and 9 a low friction interface is provided between the inner shell 14 and the energy absorbing layer 3. This may be implemented by the appropriate selection of at least one of the material used to form the outer surface of the energy absorbing layer 3 or the material used to form the inner shell 14. Alternatively or additionally, a low friction coating may be applied to at least one of the opposing surfaces of the inner shell 14 and the energy absorbing layer 3. Alternatively or additionally, a lubricant may be applied to at least one of the opposing surfaces of the inner shell 14 and the energy absorbing layer 3.

In FIGS. 8 and 9, at least one connector 20 may be connected to the inner shell 14. Alternatively or additionally, one or more of the connectors 20 may be connected to another part of the remainder of the liner 15 or comfort padding 16.

In another arrangement, the connector may be used with a helmet 1 of the type shown in FIG. 10. The helmet shown in FIG. 10 has a similar configuration to that discussed above in respect of FIGS. 1, 2, 3A and 3B. In particular, the helmet has a relatively hard outer shell 2 and an energy absorbing layer 3 configured to slide relative to each other. At least one connector 20 may be connected to the outer shell 2 and the energy absorbing layer 3. Alternatively, the connector may be connected one or more intermediate sliding layers associated with one or both of the outer shell 2 and the energy absorbing layer 2, which provide low friction.

In yet another arrangement, the connector may be used with a helmet 1 of the type shown in FIG. 11. The helmet shown in FIG. 11 has a similar configuration to that discussed above in respect of FIG. 3B. In particular, the helmet has a relatively hard outer shell 2 and an energy absorbing layer 3 which is divided into outer and inner parts 3A, 3B 3 configured to slide relative to each other. At least one connector 20 may be connected to the outer and inner parts 3A, 3B of the energy absorbing layer 3. Alternatively, the connector may be connected one or more intermediate sliding layers associated with one or both of the outer and inner parts 3A, 3B of the energy absorbing layer 3, which provide low friction.

FIG. 12 depicts yet another alternative arrangement of a helmet 1. In this arrangement, one or more outer plates 17 may be mounted to a helmet 1 having at least an energy absorbing layer 3 and a relatively hard layer 2 formed outward of the energy absorbing layer 2. It should be understood that such an arrangement of outer plates 17 may be added to any helmet according to any of the arrangements discussed above, namely having a sliding interface between at least two of the layers of the helmet 1.

The outer plates 17 may be mounted to the relatively hard layer 2 in a manner that provides a low friction interface between the outer surface of the relatively hard layer 2 and that least a part of a surface of the outer plate 17 that is in contact with the outer surface of the relatively hard layer 2, at least under an impact to the outer plate 17. In some arrangements, an intermediate low friction layer may be provided between the hard layer 2 and the plates 17

In addition, the manner of mounting the outer plates 17 may be such that, under an impact to an outer plate 17, the outer plate 17 can slide across the relatively hard layer 2 (or intermediate low friction layer). Each outer plate 17 may be connected to the remainder of the helmet 1 by one or more connectors 20.

In such an arrangement, in the event of an impact on the helmet 1, it can be expected that the impact would be incident on one or a limited number of the outer plates 17. Therefore, by configuring the helmet such that the one or more outer plates 17 can move relative to the relatively hard layer 2 and any outer plates 17 that have not been subject to an impact, the surface receiving the impact, namely one or a limited number of outer plates 17, can move relative to the remainder of the helmet 1. In the case of an oblique impact or a tangential impact, this may reduce the transfer of rotational forces to the remainder of the helmet. In turn, this may reduce the rotational acceleration imparted on the brain of a wearer of the helmet and/or reduce brain injuries.

Possible arrangements of connectors 20 will now be described. For convenience the connectors will generally be described as connecting an interface layer (e.g. liner 15 or padding layer 16) to an energy absorbing layer of a helmet, such as is shown in FIGS. 8 and 9. However, it should be appreciated that the connector 20 may be used for connecting any two parts of an apparatus together, e.g. any of the layers described above. Furthermore, where below the connector 20 is described as having a first component connected to a first part of an apparatus, e.g. an energy absorbing layer, and a second component connected to a second part of an apparatus, e.g. an interface layer, it should be appreciated that, with suitable modifications, this may be reversed.

FIGS. 13 to 16 show different views of a first example connector 20 in accordance with the disclosure. As explained above, the connector 20 is suitable for connecting inner and outer layers of an apparatus, such as a helmet.

The connector 20 generally comprises an anchor point 21 configured to be connected to the interface layer of a helmet. The connector 20 further comprises a resilient portion 22 arranged to at least partially surround the anchor point 21, about a first axis A extending in a first direction, and connected to the anchor point 21. A peripheral portion 23 of the connector 20 is arranged to at least partially surround the resilient portion 22, about a second axis B extending in the first direction, and connected to the resilient portion 22. The peripheral portion 23 is also configured to be connected to the energy absorbing layer 3 of the helmet and/or an intermediate low friction layer 4 associated with the energy absorbing layer 3. The connector 20 further comprises attachment means 24, on a surface of the connector opposite to the anchor point 21, for attaching the connector 20 to the energy absorbing layer 3. The resilient portion 22 is configured to deform to allow the anchor point 21 to move relative to the peripheral portion 23 in a direction perpendicular to the first direction.

In the example shown in FIGS. 13 to 16 the anchor point 21 comprises two arms 21*a* extending in mutually different directions. As shown, the arms 21*a* may extend perpendicularly to the first axis A. The arms 21*a* may be configured to be inserted through a hole in the layer to which the anchor point 21 is attached, then extend in order to prevent the connector 20 being disconnected from the layer. Accordingly, the arms 21*a* may be formed from a resilient material, e.g. the same material as the resilient portion 22. The arms 21*a* may have a shape configured to make removal from the hole more difficult. For example, as shown, the arms may comprise a narrow portion at a central portion of the anchor point 21 configured to fit within the hole, and a wider portion further out which is wider than the hole. Additionally, the wider portion may taper down further away from the central portion, so that the arms 21*a* can be fit into the holes more easily. As shown in FIGS. 13 to 16, the outermost portion of the arms 21*a* may be again wider than the narrowest portion of the tapered portion, though this is not the case in the variation of this example connector shown in FIG. 33. The arms 21*a* may be substantially flat. This may reduce the point pressure felt by a wearer from the arms 21*a*.

However, alternative arrangement are possible, for example, the anchor point 21 may be connected to the energy absorbing layer 3 by glue, a hook-and-loop arrangement or a magnet instead.

As shown in FIG. 16, the anchor point 21 may be formed within a part of the material forming the resilient portion 22. Alternatively, the anchor point 21 may be formed from a relatively rigid material connected to, or integrated with, the material forming the resilient portion 22.

It should be understood that the term anchor point refers generally to any structure configured to attach (or anchor) the connector 20 to a part of the helmet 1. However, in some embodiments, the anchor point 21 may be relatively small compared to the connector 20 so as to be located substantially at a point on the connector 20, e.g. a point on the first axis A.

The peripheral portion 23 is primarily provided for connection of the connector 20 to the energy absorbing layer 3. However, the peripheral portion 23 may also provide strength and stability to the connector 20. Accordingly, the peripheral portion may be formed from a relatively rigid material compared to the material forming the resilient portion 22. The rigid material may be configured to retain its shape, under an impact to the helmet 1, while the resilient portion 22 deforms under the same impact. The rigid material may be, for example, PTFE, ABS, PVC, PC, Nylon, PFA, EEP, PE, UHMWPE, and metal.

As shown in FIGS. 13 to 16, the peripheral portion 23 may be substantially annular in shape. The peripheral portion 23 accordingly defines a central region surrounded by the annulus. The annular shape shown in FIGS. 13 to 15 is an example of a connector 20 in which the peripheral portion 23 forms a closed loop surrounding a central region. However, other examples may have different shapes, such as rectangular, square triangular, or any other arbitrary shape. Furthermore, in other examples, the peripheral portion 23 may not be closed around a central region, while still surrounding said central region. The second axis B, may pass through the centre of the central region, e.g. the centre of the annular peripheral region 23.

As shown in FIG. 16, the peripheral portion 23 may be substantially flat. In other words, the peripheral portion 20 may have a relatively small thickness compared to its length and width. The length and width directions may define a plane (horizontal in FIG. 16), with the thickness direction (vertical in FIG. 16) being perpendicular to the plane. The thickness direction corresponds to the first direction defined above.

The peripheral portion 23 may have a substantially flat outer surface (i.e. facing away from the anchor point 21). This surface may be configured to connect to the energy absorbing layer 3. The flat surface may be in a plane perpendicular to the first direction.

The attachment means 24 may be provided on a surface of the peripheral portion 23, as shown in FIG. 16. In this example, the attachment means is a hook-and-loop material (e.g. Velcro™) provided on the surface of the peripheral portion 23. Note that the hook-and-loop material may only partially cover the peripheral portion 23 and/or may additionally cover a central portion surrounded by the peripheral portion 23.

In other examples different attachment means may be provided, such as snap pin(s), magnet(s), or adhesive.

In the example connector 20 of FIGS. 13 to 16, the anchor point 21 and attachment means are provided facing outwards from the connector, i.e. in mutually opposite directions. Accordingly, the connector 20 is configured to be arranged in a space between inner and outer layers of the helmet. In this example, the peripheral portion 23 and resilient portion 22, at least, are configured to be arranged between inner and outer layers of a helmet.

In the example shown in FIGS. 13 to 15, the first axis A passes through the anchor point 21. The first axis A is coincident with the second axis B in the present example. In other words, both the axes are the same. However, this is not essential. In the present example, the peripheral portion 23 and the resilient portion 22 have rotational symmetry about the coincident first and second axes.

In the example shown in FIGS. 13 to 16, a part of the material forming the resilient portion 22 extends underneath the peripheral portion 23 (i.e. on the side of the interface layer rather than the side of energy absorbing layer) and a part of the peripheral portion 23 surrounds that part of the material forming the resilient portion 22. This helps to provide a secure connection between the resilient portion 22 and the peripheral portion 23. Further, the resilient portion 22 may be integrally formed with the peripheral portion 23, e.g. by co-moulding the different materials together.

FIGS. 13 to 16 show the connector 20 when it is not connected to the helmet 1, in this state the resilient portion 22 is in a non-deformed state. FIG. 17 shows the connector 20 of FIGS. 13 to 15 when it is connected to both the interface layer 15 of the helmet 1 and the energy absorbing layer 3. When both unconnected and connected to the helmet 1, the resilient portion 22 of the example is configured to protrude from the peripheral portion 23 in the first direction.

As shown, the resilient portion 21 is substantially cup-shaped. In other words the resilient portion 22 defines a concave region, coinciding with the central region defined by the peripheral portion 23. In this example, the concave region defined by the resilient portion 22 is completely surrounded by the resilient portion 22 about the first axis A. In other words, the resilient portion 22 is continuous, i.e. has no gaps or holes therein. Further, the resilient portion 22 is arranged such that the cup-shape tapers in from the peripheral-portion-side to the anchor-point-side.

As shown in FIG. 17, resilient portion 22 is positioned on an outer side of the interface layer 15. In other words, the resilient portion 22 is arranged on a side of the interface layer 15 adjacent to the sliding interface (which is between the interface layer 15 and the energy absorbing layer 3). A through-hole 15A is provided in the interface layer 15, to allow connection of the connector 20 thereto, via arms 21*a*. In some example, the arms may be covered by a sticker, e.g. adhesive backed paper or film, in order to hold the arms in place on the layer that they are threaded through and/or to smooth the edges of the arms to reduce point pressure on the head, if arranged to be in contact with the head.

As shown in FIG. 17, peripheral portion 23 is positioned on an inner side of the energy absorbing layer 3. In other words, the peripheral portion 23 is arranged on a side of the energy absorbing layer 3 adjacent to the sliding interface. The connector 20 is connected to the inside facing surface of the energy absorbing layer via the attachment means 24. As shown in FIG. 17, the outer facing surface of the peripheral portion faces and abuts the inner facing surface of the energy absorbing layer. Although not shown explicitly, the energy absorbing layer may be provided with attachment means complementary to the attachment means 24 of the connector 20 (e.g. opposing hook-and-loop material, opposing poled magnet, snap-pin housing). Further, although FIG. 17 depicts a substantially flat surface of the energy absorbing layer 3, to which the connector 20 is attached, alternatively, the connector 20 (i.e. peripheral portion 23) may be located in a recessed portion of the surface of the energy absorbing layer 3.

When connected to the helmet 1, the resilient portion 22 may be in a non-deformed or deformed state. The resilient portion 22 is able to deform/further deform to allow the anchor point 21 to move relative to the peripheral portion 23 in a direction perpendicular to the first direction.

FIG. 18 shows a second example connector 20, similar in many respect to the first example connector. In particular, the resilient portion 22 of the fifth example connector 20 protrudes from the resilient portion 23 in the first direction, in the non-deformed state, e.g. when not connected to the helmet 1. However, in the present example, the resilient portion 22 is provided in multiple sections separated by gaps. Specifically there are four sections, which form an X-shape, in this example. The anchor point 21 is located at the centre of the X-shape, although this is not essential. More generally, the multiple sections of the resilient portion 22 may extend in a radial direction relative to the first axis A surrounded by the resilient portion 22. Further, the resilient portion 22 may have rotational symmetry about the first axis A. Any number of sections may be provided.

As with the previous example connectors 20, when connected, the resilient portion 22 of the present example is configured to protrude from the peripheral portion 23 in the first direction, through the outer shell 2. The resilient portion 22 substantially remains in its non-deformed state when it is connected thus. However, some deformation may occur. The resilient portion 22 is able to deform (or further deform) to allow the anchor point 21 to move relative to the peripheral portion 23 in a direction perpendicular to the first direction.

Further, the anchor point 21 of the present example connector 20 is different to that of the previous example connector 20. In particular, the anchor point of the present example connector comprises a through hole 21 for the insertion of a snap-pin. The interface layer may comprise a corresponding snap-pin housing.

FIGS. 19 and 20 show a third example connector 20. This connector 20 is similar in many respects to the second example connector 20. Accordingly, the major differences will be described.

As shown in FIGS. 19 and 20, the peripheral portion 23 of the connector 20 of the sixth example comprises protrusions extending substantially radially with respect to the second axis B. Additionally, the connector 20 comprises an insert 26 configured to be inserted into the peripheral portion 23. The insert 26 is made from a rigid material (e.g. those described above in relation to the peripheral portion 23 of the previous examples) and configured to prevent the peripheral portion 23 deforming and/or becoming displaced. Accordingly, the peripheral portion 23 of the present example is formed from a resilient material, e.g. the resilient material forming the resilient portion 22 of the connector 20. The insert 26 may be configured, as in this example, to be inserted into the protrusions of the peripheral portion 23. As shown, the insert 26 may comprise a central portion, substantially corresponding in shape to the central region defined by the peripheral portion 23, and protrusions therefrom, substantially corresponding in shape to the protrusions of the peripheral portion 23.

FIGS. 21 and 22 show a fourth example connector 20. In contrast to previous examples, in this example, when in a non-deformed state, the resilient portion 22 is substantially flat. In other words, the resilient portion 22 does not substantially protrude from the peripheral portion 23 in the first (thickness) direction. However, when connected to both layers of the helmet, the resilient portion 22 does protrude from the peripheral portion 23 in the first (thickness) direction, due to a separation between the interface layer 15 and the energy absorbing layer 3. In this case, the previously flat connector takes the form of the cup-shaped connectors described above.

As shown in FIGS. 21 and 22, the resilient portion 22 of the third example connector covers the entirety of the central region. In other words, the resilient portion 22 is substantially disc-shaped. In other examples in which the peripheral portion is not annular, the resilient portion 22 may be generally formed as a sheet. Further, although the resilient portion 22 extends over the top of the peripheral portion 23. In some examples the resilient portion could also surround the peripheral portion 23. Being disc-shaped, the overlap with the top of the peripheral portion 23 is relatively large, thus adequately securing the resilient portion 22 to the peripheral portion 22.

FIGS. 23 and 24 show fifth and sixth example connectors 20 having alternative arrangements for the anchor point 21. In these examples, a through-hole of the anchor point 21 is formed from a relatively hard material, e.g. the same materials the peripheral portion 23. This may be co-moulded with the material forming the resilient portion 22 for example. As shown in FIG. 23, the anchor point 21 comprises a circular through-hole. As shown in FIG. 24, the anchor point 21 comprises a substantially circular through-hole with further (e.g. four) cut-out portions extending radially from the circular portion (e.g. to form a cross shape). In both cases, the through-hole may be configured to snap fit with a snap-pin associated with the layer to which it is attached, e.g. the energy absorbing layer 3.

FIGS. 25 and 24 show a seventh example connector 20. This connector 20 is similar in many respects to the fourth example connector 20. Accordingly, the major differences will be described. As shown in FIGS. 23 and 24, the material forming the resilient portion 22 extends underneath the peripheral portion, rather than over the top. Further, the material forming the resilient portion 22 completely covers the peripheral portion on one side, rather than just partially covering the peripheral portion. This provides a more secure attachment between the resilient portion 22 to the peripheral portion 22.

FIGS. 27 and 28 show an eighth example connector 20. This connector 20 is similar in many respects to the previous example connector 20. Accordingly, the major differences will be described. In the present example, the resilient portion 22 is provided in multiple sections separated by gaps. Specifically there are four sections, which form a Y-shape, in this example. The anchor point 21 is located at the centre of the Y-shape, although this is not essential. More generally, the multiple sections of the resilient portion 22 may extend in a radial direction relative to the first axis A surrounded by the resilient portion 22. Further, the resilient portion 22 may have rotational symmetry about the first axis A. Any number of sections may be provided. Accordingly, the resilient portion 22 of the second example connector may have four sections, rather than three. The four sections may form a X-shape, as shown in the ninth example connector of FIG. 29.

Generally, the connectors 20 described above may be configured such that the peripheral portion lies substantially in a plane parallel to the layer to which it is attached, i.e. a plane substantially perpendicular to the radial direction of a helmet. The first and/or second axes described above may be configured to extend substantially in the radial direction of a helmet. The connector 20 may permit relative movement between layers substantially perpendicular to the radial direction of a helmet.

Various arrangements are described above for attaching the peripheral portion 23 to the helmet. However, alternatively, the peripheral portion 23 may be part of, or integrally formed with, the energy absorbing layer 3.

Some example helmets, such as those shown in FIGS. 1 to 11, are configured to cover a top portion of the head and the above described helmet structures are appropriately located in the helmet to cover a top portion of the head. For example, a helmet may be provided to substantially cover the forehead, top of the head, back of the head and/or temples of the wearer. The helmet may substantially cover the cranium of the wearer.

Some example helmets may be configured to cover other parts of the head, alternatively or additionally to a top portion. For example, helmets such as the helmet shown in FIG. 32 may cover the cheeks and/or chin of the wearer. Such helmets may be configured to substantially cover the jaw of the wearer. Helmets of the type shown in FIG. 32, are often referred to as full-face helmets. As shown in FIG. 32, cheek pads 30 may be provided on either side of the helmet 1 (i.e. left and right sides). The cheek pads 30 may be arranged within an outer shell 2 of the helmet 1 to protect the side of the face of the wearer from an impact.

The cheek pads 30 may have the same layered structure as the example helmets described above. For example, the cheek pads 30 may comprise one or more energy absorbing layers as described above, and/or an interface layer as described above. The cheek pads 30 may comprise inner and outer layers that can move relative to each other as described above.

The connectors described above may connect the check pads 30 to a portion of the outer shell 2 of the helmet 1 to enable relative sliding between the cheek pad and the outer shell, or may connect inner and outer layers of the cheek pad 30 to enable sliding between the inner and outer layers.

Although, the above examples relate to cases in which the apparatus is a helmet, the apparatus may be alternative protective apparel. For example, the apparatus may comprise body armour 100 for other parts of the body, such as the shins, knees, thighs, forearms, elbows, upper arms, shoulders, chest and back, as shown in FIGS. 30 and 31. Individual items of body armour may be provided to protect individual body parts (as shown in FIG. 30), or alternatively may be combined in apparel comprising multiple armoured regions 101 to protect more than one body part (as shown in FIG. 31). Such body armour 100 may be worn for the same activities as helmets, discussed above, including for combat, sports, and motorcycling.

The body armour 100 may have the same layered structure as the example helmets described above. For example, as shown in FIG. 30, the body armour 100 may comprise an inner layer 3, an outer layer 2, a sliding interface between the inner layer 3 and the outer layer 2; and at least one connector 20 connected to the inner and outer layers so as to allow relative sliding between the inner and outer layers 3, 2 at the sliding interface, in response to an impact to the apparatus 100. In the example shown, the outer layer is an outer shell 2 and the inner layer 3 an energy absorbing layer, analogous to the helmet arrangement shown in FIG. 10. However, other arrangements are of course possible, e.g. arrangements analogous to those shown in any other of FIGS. 1 to 12 or described above. Additional features of the helmets described above may also be provided in body armour. Where "head" is used in the context of the helmets discussed above, the same analogously applies to a different body part being protected, in the context of body armour.

It should be understood that features of each of the examples described above may be combined. For example any one of the above examples may be modified to include features described in relation to any other of the examples. For example, any one of the different arrangements of the peripheral portion 23 and/or resilient portion 22 may be interchanged. Further, any one of the arrangements for aligning or anchoring the peripheral portion in the outer shell 2 may be used with any of the described connectors 20 and in combination with other arrangements. Further still, any type of fastening means may be used to connect the anchor point 21 of any of the above connectors to the helmet 1.

The invention claimed is:

1. A connector for connecting inner and outer layers of an apparatus, the connector comprising:

an anchor point configured to be connected to one of the inner and outer layers;

a resilient portion arranged to at least partially surround the anchor point about a first axis extending in a first direction and connected to the anchor point;

a peripheral portion arranged to at least partially surround the resilient portion about a second axis extending in the first direction and connected to the resilient portion, and configured to be connected to the other of the inner and outer layers; and attachment means on a surface of the connector opposite to the anchor point, for attaching the connector to the inner or outer layer not to be connected to the anchor point;

wherein the resilient portion is configured to protrude from the peripheral portion in the first direction, in a connected state in which the connector is connected to the inner and outer layers, and deform to allow the anchor point to move relative to the peripheral portion in a direction perpendicular to the first direction; and wherein the anchor point comprises two arms extending in mutually different directions, the arms being configured to be inserted through a hole in the inner or outer layer to which the anchor point is attached and extend in order to prevent the connector being disconnected from the inner or outer layer.

2. The connector according to claim 1, wherein in the anchor point is formed from a resilient material.

3. The connector according to claim 1, wherein the peripheral portion is formed from a rigid material.

4. The connector according to claim 1, wherein the attachment means is provided on a surface of the peripheral portion.

5. The connector according to claim 1, wherein the attachment means is a hook and loop attachment means.

6. The connector according to claim 1, wherein in a non-deformed state, the resilient portion is substantially flat, and the connected state is a deformed state of the resilient portion.

7. The connector according to claim 1, wherein in a non-deformed state, the resilient portion protrudes from the peripheral portion in the first direction.

8. The connector according to claim 1, wherein the resilient portion extends across a central region of the connector surrounded by the peripheral region and substantially covers the entirety of the central region.

9. The connector according to claim 1, wherein the peripheral portion forms a closed loop, is substantially annular and the second axis passes through the center of the peripheral portion.

10. The connector according to claim 9, wherein the anchor point is aligned with the first axis.

11. The connector according to claim 1, wherein the first and second axes are coincident.

12. The connector according to claim 1, wherein the resilient portion and the peripheral portion are integrally formed.

13. The connector according to claim 1, wherein the anchor point comprises a snap-fit connector configured to snap fit with the inner or outer layer.

14. An apparatus comprising:

an inner layer;

an outer layer;

a sliding interface between the inner layer and the outer layer; and the connector according to claim 1 connected to the inner and outer layers so as to allow relative sliding between the inner and outer layers at the sliding interface, in response to an impact to the apparatus.

15. The apparatus according to claim 14, wherein the peripheral portion is arranged between the inner and outer layers.

16. The apparatus according to claim 14, wherein the inner or outer layer comprises a further attachment means complementary to the attachment means of the connector.

17. The apparatus according to claim 14, wherein the attachment means of the connector is connected to an inside facing surface of the outer layer of the apparatus.

* * * * *